US008943833B2

(12) United States Patent
Tuthill et al.

(10) Patent No.: US 8,943,833 B2
(45) Date of Patent: Feb. 3, 2015

(54) FUEL FLEXIBLE FUEL INJECTOR

(75) Inventors: Richard S. Tuthill, Bolton, CT (US); Dustin W. Davis, Marlborough, CT (US); Zhongtao Dai, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 89 days.

(21) Appl. No.: 13/542,985

(22) Filed: Jul. 6, 2012

(65) Prior Publication Data

US 2014/0007581 A1 Jan. 9, 2014

(51) Int. Cl.
*F02C 1/00* (2006.01)

(52) U.S. Cl.
USPC ..... 60/748; 60/737; 60/747

(58) Field of Classification Search
USPC ..... 60/748; 239/405, 416.4, 416.5, 423, 239/419, 419.3, 399–400
See application file for complete search history.

(56) References Cited

U.S. PATENT DOCUMENTS

| | | | | |
|---|---|---|---|---|
| 5,603,211 | A | 2/1997 | Graves | |
| 5,613,363 | A | 3/1997 | Joshi et al. | |
| 5,713,206 | A * | 2/1998 | McWhirter et al. | 60/747 |
| 5,735,681 | A | 4/1998 | Cheng | |
| 5,778,676 | A | 7/1998 | Joshi et al. | |
| 5,879,148 | A | 3/1999 | Cheng et al. | |
| 6,141,967 | A | 11/2000 | Angel et al. | |
| 6,389,815 | B1 | 5/2002 | Hura et al. | |
| 6,715,292 | B1 | 4/2004 | Hoke | |
| 7,093,445 | B2 | 8/2006 | Corr, II et al. | |
| 7,150,416 | B2 | 12/2006 | Martin et al. | |
| 7,434,401 | B2 | 10/2008 | Hayashi | |
| 7,878,000 | B2 | 2/2011 | Mancini et al. | |
| 2007/0028624 | A1 | 2/2007 | Hsieh et al. | |
| 2010/0269507 | A1 | 10/2010 | Khan et al. | |
| 2011/0088401 | A1 | 4/2011 | Mancini et al. | |
| 2011/0314824 | A1 | 12/2011 | Cheung | |

OTHER PUBLICATIONS

International Search Report and Written Opinion for PCT Application No. PCT/US2013/047755 mailed on Oct. 10, 2013.
U.S. Appl. No. 13/417,380, filed Mar. 12, 2012 "Fuel Air Premixer for Gas Turbine Engine".

* cited by examiner

*Primary Examiner* — William H Rodriguez
*Assistant Examiner* — Scott Walthour
(74) *Attorney, Agent, or Firm* — Carlson, Gaskey & Olds, P.C.

(57) ABSTRACT

A disclosed fuel injector provides mixing of fuel with airflow by surrounding a swirled fuel flow with first and second swirled airflows that ensures mixing prior to or upon entering the combustion chamber. Fuel tubes produce a central fuel flow along with a central airflow through a plurality of openings to generate the high velocity fuel/air mixture along the axis of the fuel injector in addition to the swirled fuel/air mixture.

13 Claims, 5 Drawing Sheets

FUEL FLEXIBLE FUEL INJECTOR

STATEMENT REGARDING FEDERALLY SPONSORED RESEARCH OR DEVELOPMENT

This subject of this disclosure was made with government support under Contract No.: DE-AC02-05-CH11231 awarded by the United States Department of Energy. The government therefore may have certain rights in the disclosed subject matter.

BACKGROUND

A gas turbine engine typically includes a compressor section, a combustor section and a turbine section. Air entering the compressor section is compressed and delivered into the combustion section where it is mixed with fuel and ignited to generate a high temperature exhaust gas flow. The exhaust gas flow is then turned tangentially, and accelerated by turbine inlet guide vanes such that the high-speed exhaust gas flow expands through the turbine section to drive the compressor.

Premixing fuel and air prior to combustion in the combustion chamber has become the most widely employed method for achieving low oxides of nitrogen ($NO_x$) emissions from a gas turbine. However, in many alternate fuels, particularly hydrogen-containing fuels, premixing the fuel and air presents challenges to prevent flashback, autoignition, and other premixer burning. Premixing may also increase the likelihood of large pressure pulsations driven by combustion dynamics. These challenges are heightened if the fuel composition varies from the design values used in the development of the combustor. Accordingly, it is desirable to design and develop devices that provide a thorough mixing of fuel and air for the combustion process that are also fuel-flexible to the extent that variations in fuel composition and hydrogen content are tolerated with no adverse effects.

SUMMARY

A fuel injector for a gas turbine engine according to an exemplary embodiment of this disclosure, among other possible things includes a chamber disposed along an axis including a bulkhead at a forward end and an opening at an aft end, a first annular passage disposed about the chamber, the first annular passage including a first plurality of vanes to generate a swirled first airflow, a second annular passage disposed about the first annular passage, the second annular passage including a second plurality of vanes to generate a swirled fuel flow, a third annular passage disposed about the second annular passage, the third annular passage including a third plurality of vanes to generate a swirled second airflow, and a plurality of openings through the bulkhead at a forward most portion of the chamber for communicating a central airflow to the chamber.

In a further embodiment of the foregoing fuel injector, includes a plurality of fuel tubes disposed about the axis and extending through the bulkhead into the chamber to communicate a second fuel flow to the chamber.

In a further embodiment of any of the foregoing fuel injectors, the plurality of fuel tubes includes a central tube disposed along the axis and a first plurality of fuel tubes disposed about the central tube, with at least some of the plurality of openings disposed between the central tube and the first plurality of fuel tubes.

In a further embodiment of any of the foregoing fuel injectors, includes a second plurality of fuel tubes disposed about the first plurality of fuel tubes with at least some of the plurality of openings disposed between the first plurality of fuel tubes and the second plurality of fuel tubes.

In a further embodiment of any of the foregoing fuel injectors, the fuel tubes include an open end that is spaced apart from the bulkhead.

In a further embodiment of any of the foregoing fuel injectors, includes a fuel manifold disposed at an aft end of the plurality of fuel tubes for supplying fuel.

In a further embodiment of any of the foregoing fuel injectors, includes an annular fuel chamber disposed aft of the second annular passage, the annular fuel chamber including a plurality of fuel inlets for receiving a fuel flow.

In a further embodiment of any of the foregoing fuel injectors, includes a duct extending from the aft end of the chamber to a combustion chamber.

In a further embodiment of any of the foregoing fuel injectors, the second annular passage is disposed between the first annular passage and the third annular passage.

A combustor system for a gas turbine engine according to an exemplary embodiment of this disclosure, among other possible things includes a combustor defining a combustor chamber, a fuel air mixer including a chamber disposed along an axis including a bulkhead at a forward end and an opening at an aft end, a first annular passage disposed about the chamber, the first annular passage including a first plurality of vanes to generate a swirled first airflow, a second annular passage disposed about the first annular passage, the second annular passage including a second plurality of vanes to generate a swirled fuel flow, a third annular passage disposed about the second annular passage, the third annular passage including a third plurality of vanes to generate a swirled second airflow, and a plurality of openings through the bulkhead at a forward most portion of the chamber for communicating a central airflow to the chamber.

In a further embodiment of the foregoing combustor system, includes a plurality of fuel tubes disposed about the axis and extends through the bulkhead into the chamber to communicate a second fuel flow to the chamber.

In a further embodiment of any of the foregoing combustor systems, the fuel tubes include an open end that is spaced apart from the bulkhead.

In a further embodiment of any of the foregoing combustor systems, includes a duct extending from the aft end of the chamber to a combustion chamber.

A method of communicating a fuel air mixture to a combustor of a gas turbine engine according to an exemplary embodiment of this disclosure, among other possible things includes communicating a central airflow along an axis to a chamber, communicating a first swirled airflow about the axis to the chamber, communicating a second swirled airflow about the axis to the chamber and radially outward of the first swirled airflow, communicating a swirled fuel flow to the chamber between the first and second airflows, mixing the swirled fuel with the central, first and second airflows, and flowing the fuel air mixture through an open end of the chamber.

In a further embodiment of the foregoing method, includes injecting a non-swirled airflow into the chamber along the axis.

In a further embodiment of any of the foregoing methods, includes injecting the non-swirled airflow into the chamber intermixed with the central airflow.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
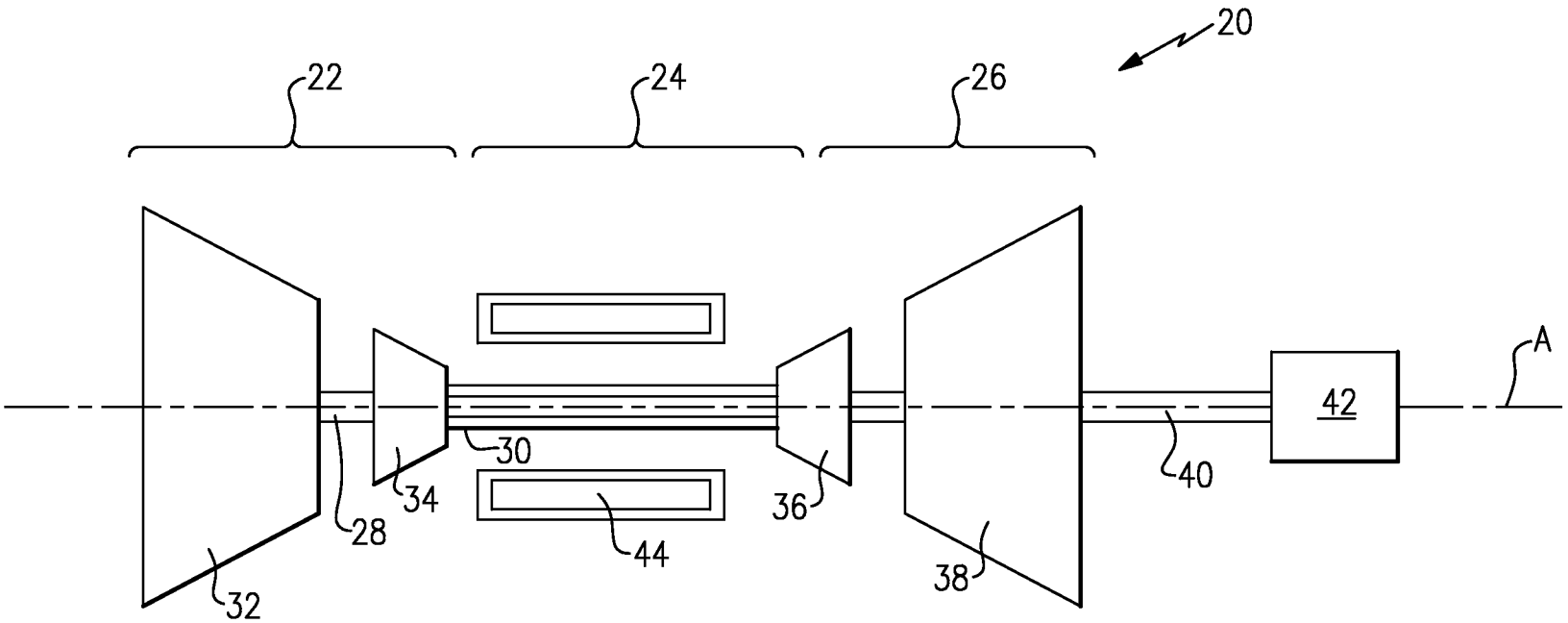
FIG. 1 is a schematic view of an example gas turbine engine.

FIG. 1 schematically illustrates an example gas turbine engine 20 that includes a compressor section 22, a combustor section 24, and a turbine section 26. Air entering the compressor section 22 is compressed and delivered to the combustion section 24 where it is mixed with fuel and ignited to generate a high-speed exhaust gas flow. The exhaust gas flow is then turned tangentially, and accelerated by turbine inlet guide vanes such that the high-speed exhaust gas flow expands through the turbine section to drive the compressor.

In this example, the compressor section 22 includes a low-pressure compressor 32 and a high-pressure compressor 34. The example turbine section 26 includes a high-pressure turbine 36 and a low-pressure turbine 38. The low-pressure turbine 38 drives an inner shaft 28 that drives the compressor 32. The high-pressure turbine 36 drives an outer shaft 30 that drives the high compressor 34. In this example, the low-pressure turbine 38 also drives a drive shaft 40 that in turn drives a generator 42. As appreciated, the example gas turbine engine 20 is utilized for industrial applications and drives the generator 42. However, the disclosures in the present specification could be utilized for other gas turbine engine applications.

Figure 2:
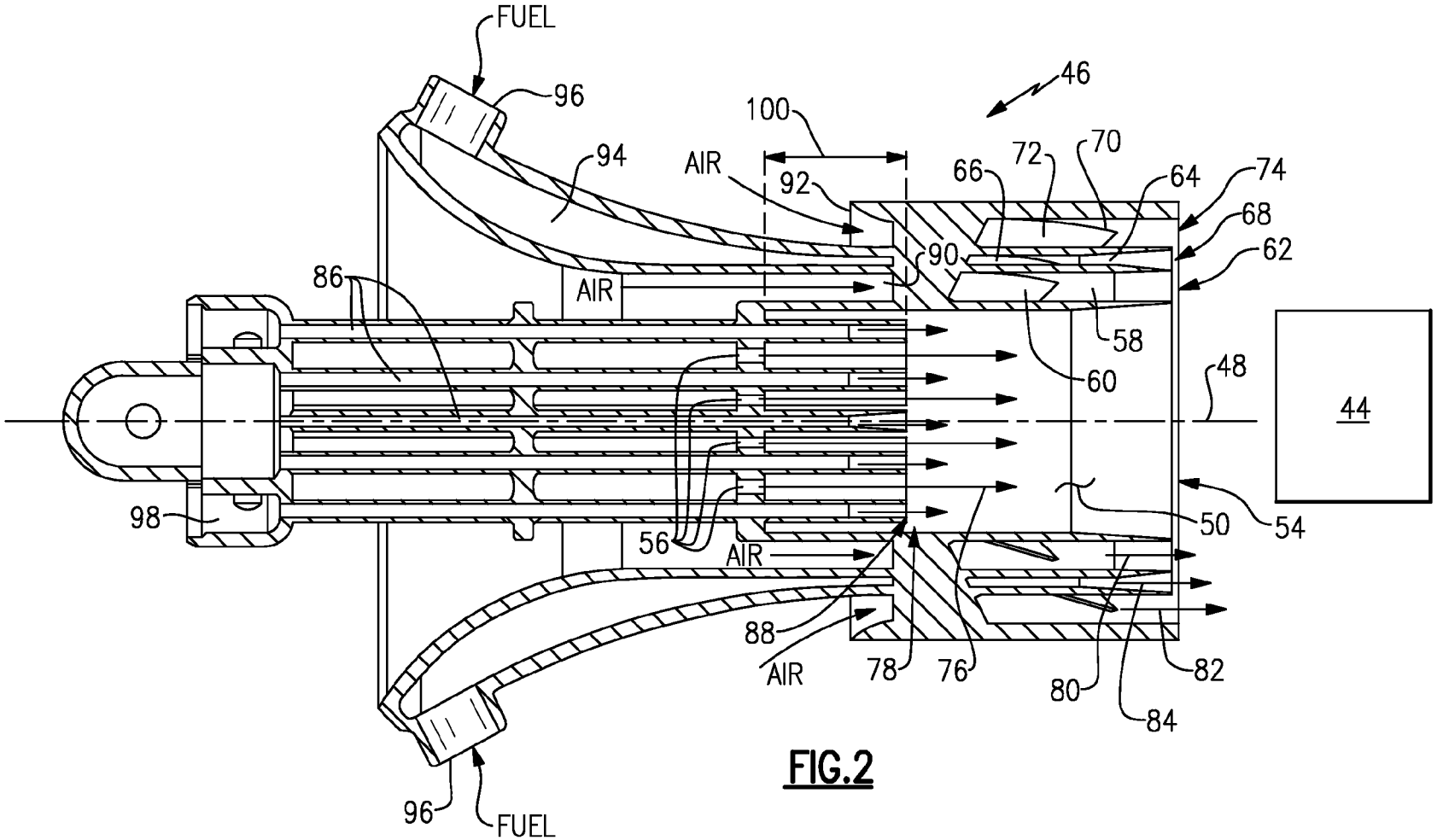
FIG. 2 is a cross sectional view of an example fuel injector.

Referring to FIG. 2, an example fuel injector 46 for mixing fuel and air and communicating that fuel air mixture to a combustion chamber 44 of the combustor section 24 is shown in cross-section. The example fuel injector 46 includes a central chamber 50 disposed about an axis 48. The chamber 50 includes a forward bulkhead 52 and an aft open end 54. The bulkhead 52 includes a plurality of openings 56 for communicating a central airflow 76 into the central chamber 50.

A first annular passage 58 is disposed about the axis 48 and about the chamber 50. The first annular passage 58 includes a plurality of vanes 60 for generating a tangential swirl component in a first swirled airflow 80. The first annular passage 58 includes an end 62 that ends in a plane common to the aft end 54 of the chamber 50.

Radially outward of the first annular passage 58 is a second annular passage 64. The second annular passage includes a second plurality of vanes 66 for creating a swirled fuel flow 84. The second annular passage 64 includes a second end 68 that also ends in a plane common with the aft opening 54.

A third annular passage 70 is disposed radially outward of the second annular passage 64 and includes a third plurality of vanes 72 for generating a tangential swirl in a second swirled airflow 82. The third annular passage 70 includes a third open end 74 that is disposed in a plane common with the aft open end 54 of the chamber 50.

Fuel is communicated through an annular fuel supply chamber 94 that receives fuel from an inlet 96. The annular fuel chamber 94 communicates fuel to the second annular passage 64. The second annular passage 64 is disposed between the first annular passage 58 and the third annular passage 70. The first annular passage 58 and the third annular passage 70 communicate airflows 80, 82 wherein the second annular passage 64 communicates fuel flow 84. Each of the first, second and third annular passages 58, 64, and 70 create a swirl component in the corresponding flow 80, 82 and 84.

Airflow is provided through inlets 90 and 92 that correspond with the first annular passage 58 and the third annular passage 70. This airflow is also communicated to an aft surface of the bulkhead 52 such that airflow is communicated through the plurality of openings 56 into the central chamber 50.

A plurality of fuel tubes 86 communicate fuel through the bulkhead 52 and into the chamber 50. Fuel flow through the fuel tubes 86 is provided in a direction along the axis 48 and does not include a swirl or tangential component. Each of the fuel tubes 86 includes an end 88 that extends past the bulkhead 52, a distance 100 into the chamber 50. As appreciated, the ends 88 of the fuel tubes 80 are spaced apart from the bulkhead 52 such that fuel is injected into the chamber 50 aft of where the central airflow 76 enters through the plurality of openings 56. The fuel tubes 86 receive fuel that is supplied to a fuel manifold 98 disposed at a forward end of the plurality of fuel tubes 86.

Figure 3:
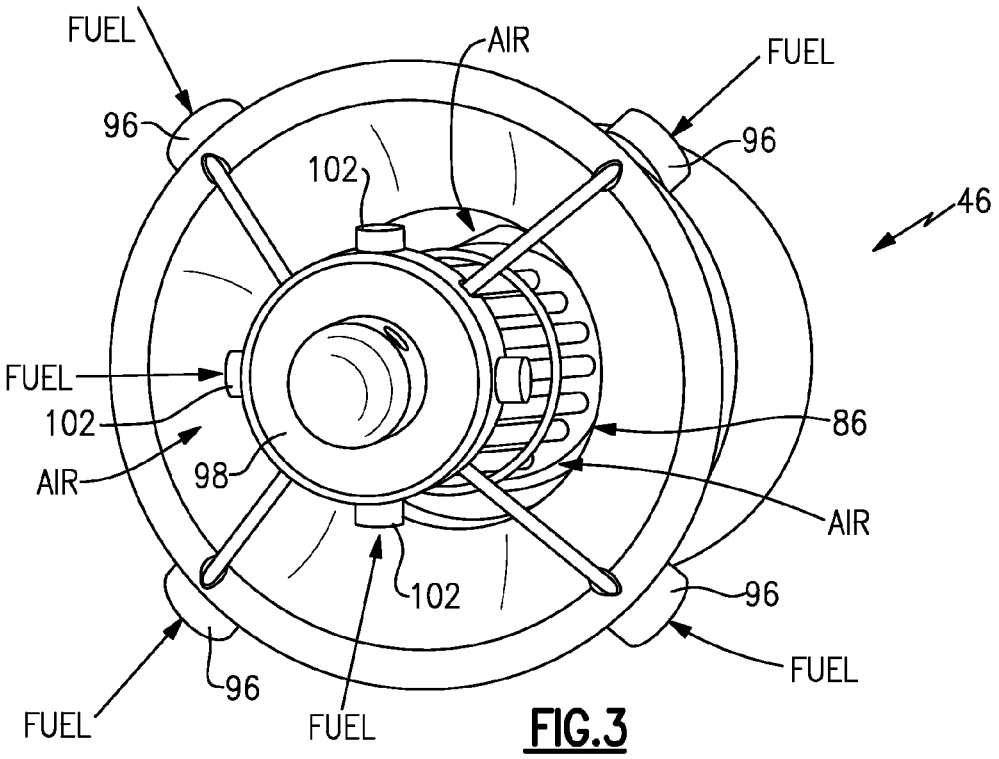
FIG. 3 is a perspective view of a rear portion of the example fuel injector.
Figure 4:
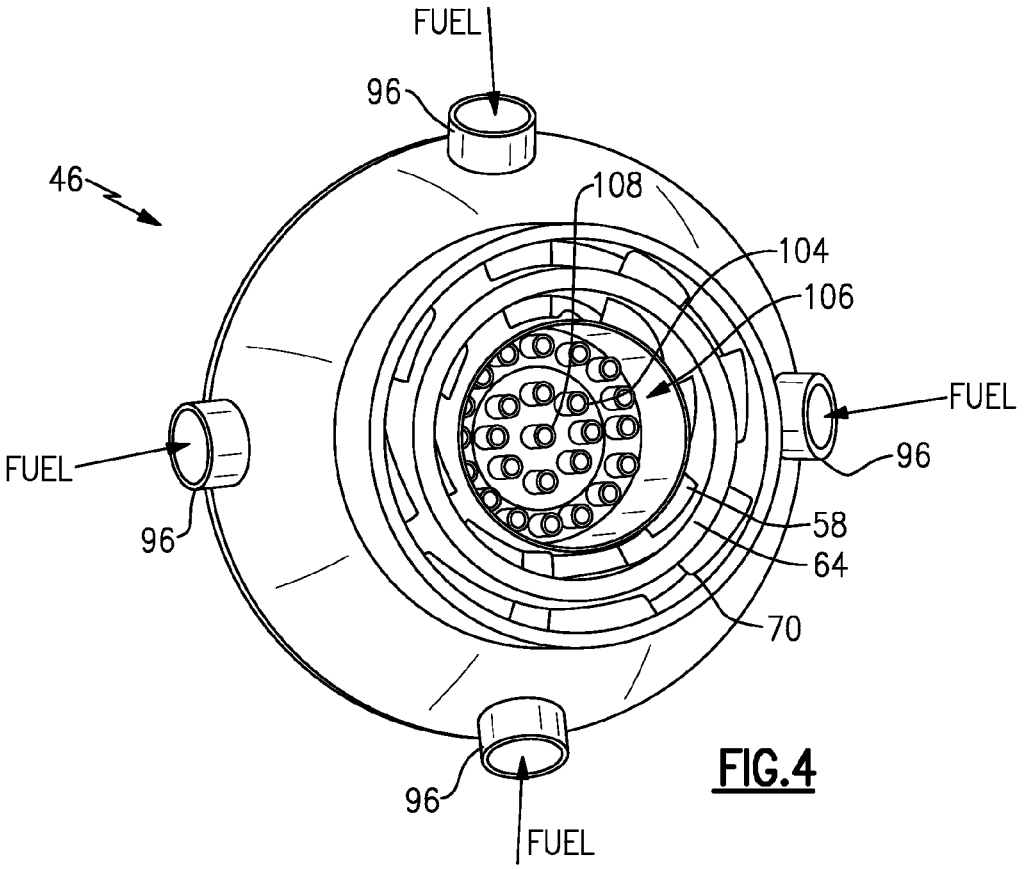
FIG. 4 is a front perspective view of the example fuel injector.

Referring to FIGS. 3 and 4 with continued reference to FIG. 2, the example fuel injector 46 includes a forward portion that receives airflow that flows around the plurality of fuel tubes 86 to enter through the openings 56 within the bulkhead 52. The fuel tubes 86 are arranged about the axis 48 and include a central fuel tube 108 that is disposed along the axis 48. A first plurality of fuel tubes 104 are disposed about the axis 48 and surround the central fuel tube 108. A second plurality of fuel tubes 106 is disposed radially outward of the first plurality of fuel tubes 104.

In this example, the first plurality of fuel tubes 104 includes eight fuel tubes 86 arranged equally about the circumference surrounding the central tube 108 and the second plurality of fuel tubes 106 includes 16 fuel tubes that are spaced equally about the axis 48 and the first plurality of fuel tubes 104. As appreciated, although a specific number of fuel tubes are shown by way of example, the number of fuel tubes could be adjusted to provide for an application's specific performance.

The fuel tubes 86 are supplied through the fuel manifold 98. The fuel manifold 98 in turn receives fuel through inlets 102. The plurality of the inlets 102 are spaced apart to allow for a uniform supply of fuel to the plurality of fuel tubes 86. The second annular passage 64 is supplied with fuel through the annular fuel supply chamber 94 that receives fuel from inlets 96. As appreciated, in this example four inlets 96 are provided for each of the fuel manifold 98 and the fuel supply chamber 94. However, different numbers of fuel inlets 96, 102 could be utilized to provide and supply fuel as required to obtain the desired fuel flows and mixtures for any application's specific parameters.

Figure 5:
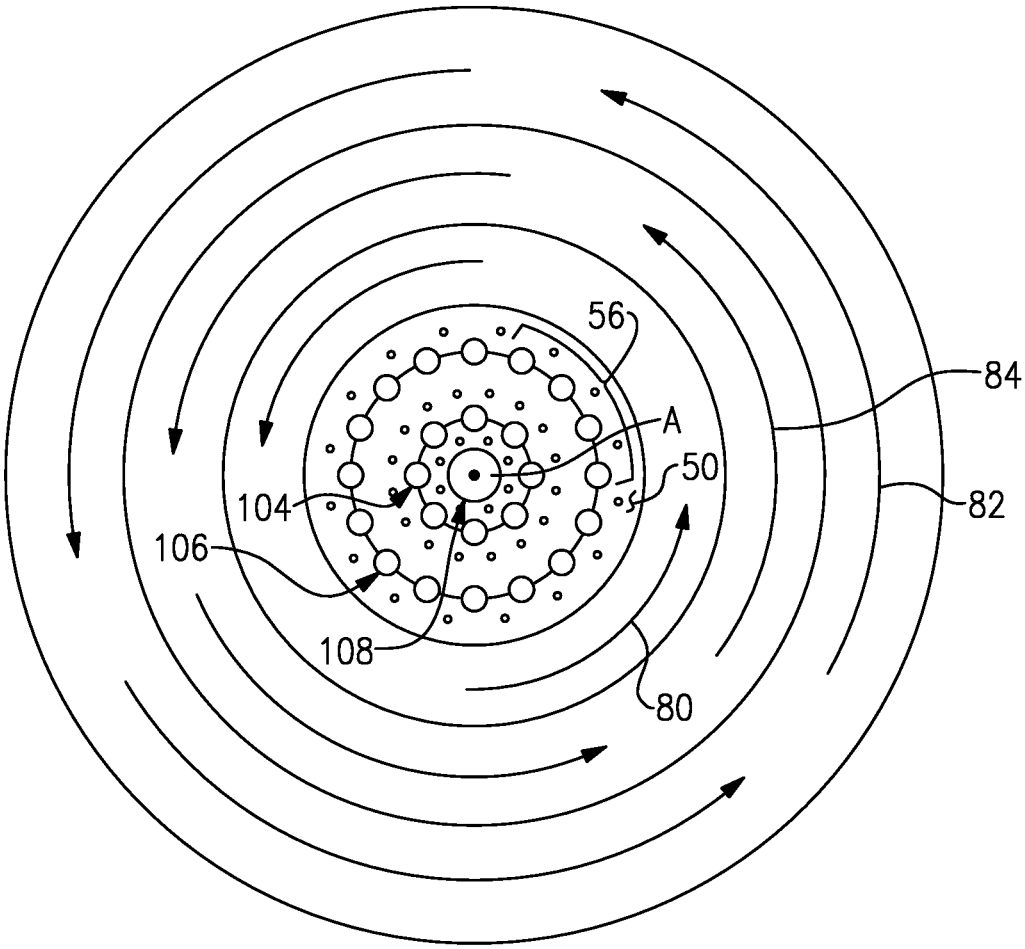
FIG. 5 is a schematic view illustrating airflows through the example fuel injector.

Referring to FIG. 5 with continued reference to FIG. 2, a schematic representation of the various air and fuel flows is illustrated. In this example, a first airflow 80 is shown with a swirl in a first direction. The fuel flow 84 is also swirled in a direction common with the first airflow 80. The second airflow 82 through the third annular passage 70 is also flowing in a common direction. It should be understood that although the example fuel flow 84 and first and second airflows 80, 82 are in a common direction, it is within the contemplation of this disclosure that the airflows and fuel flows may be swirled in different directions to further induce mixing.

A central airflow that is shown in FIG. 2 at 76 along with a central fuel flow 78 also shown in FIG. 2, flows along the axis 48 and therefore would flow in a direction out of the paper and transverse to the radial components of the swirled flows illustrated in FIG. 5.

Figure 6:
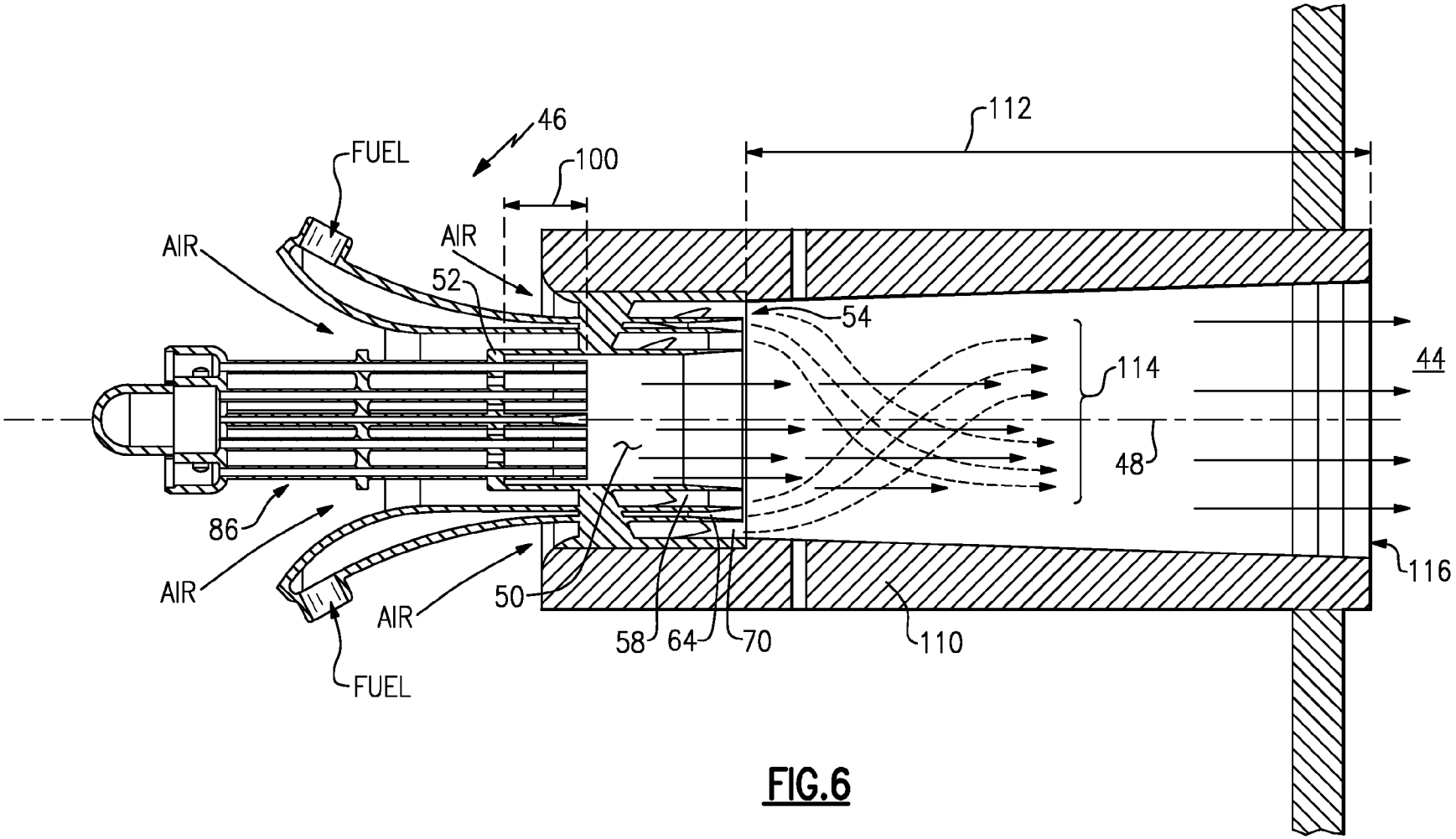
FIG. 6 is a cross sectional view of the example fuel injector including a duct for communicating fuel to a combustor chamber.

Referring to FIG. 6, the example fuel injector 46 can be mated with a duct 110 that includes a length 112 measured from the aft end 54 to the opening 116 to the combustion chamber 44. The duct 110 provides the length 112 for mixing of the various fuel and airflows such that upon entering the combustion chamber 44, the fuel flows are provided in a substantially uniform and axial direction without the swirl components induced by the vanes 60, 66, 72 within the first, second and third annular passage 58, 64 and 70 are substantially dissipated upon entering the combustion chamber 44.

The example fuel injector 46 provides for the axial airflow 76 and fuel flow 78 through the chamber 50 and out into the duct 110 to maintain a desired axial flow velocity that provides a high velocity fuel air mixture 114 flow through the fuel injector 46 and the duct 110 into the combustion chamber 44. The high velocity fuel air mixture 114 reduces the potential for premature ignition prior to the entering of the combustion chamber 44.

Accordingly, the example fuel injector provides for a thorough mixing of fuel with airflow by surrounding a swirled fuel flow 84 with first and second swirled airflows 80,82 that ensures mixing prior to or upon entering the combustion chamber 44. Moreover, the example fuel injector includes the fuel tubes 86 to produce a central fuel flow 78 along with the central airflow 76 through the plurality of openings 56 to generate the high velocity fuel/air mixture along the axis of the fuel injector 46 to prevent undesired ignition events while providing a desired swirl distribution and aerodynamic flows that are tolerant of unscheduled pre-mixer ignition events.

Although an example embodiment has been disclosed, a worker of ordinary skill in this art would recognize that certain modifications would come within the scope of this disclosure. For that reason, the following claims should be studied to determine the scope and content of this disclosure.

The invention claimed is:

1. A combustor system for a gas turbine engine comprising:

a combustor defining a combustor chamber;

a fuel air mixer including a chamber disposed along an axis including a bulkhead at a forward end and an opening at an aft end;

a first annular passage disposed about the chamber, the first annular passage including a first plurality of vanes to generate a swirled first airflow and a first open end at the aft end of the chamber;

a second annular passage disposed about the first annular passage, the second annular passage including a second plurality of vanes to generate a swirled fuel flow and a second open end at the aft end of the chamber;

a third annular passage disposed about the second annular passage, the third annular passage including a third plurality of vanes to generate a swirled second airflow and a third open end at the aft end of the chamber;

a plurality of openings through the bulkhead of the chamber for communicating a central airflow to the chamber, wherein each of the openings are open to the chamber; and a plurality of fuel tubes disposed about the axis and extending through the bulkhead into the chamber to communicate a second fuel flow to the chamber, wherein the plurality of openings are disposed between the plurality of fuel tubes.

2. The combustor system as recited in claim 1, wherein the fuel tubes include an open end that is spaced apart from the bulkhead.

3. The combustor system as recited in claim 1, including a duct extending from the aft end of the chamber to a combustion chamber.

4. The combustor system as recited in claim 1, wherein an end of each of the plurality of fuel tubes extends into the chamber and is spaced apart from the opening at the aft end of the chamber.

5. A fuel injector for a gas turbine engine comprising:

a chamber disposed along an axis including a bulkhead at a forward end and an opening at an aft end spaced axially apart from the bulkhead;

a first annular passage disposed about the chamber, the first annular passage including a first plurality of vanes to generate a swirled first airflow and a first opening at the aft end of the chamber, wherein the first plurality of vanes are spaced apart from the aft end;

a second annular passage disposed about the first annular passage, the second annular passage including a second plurality of vanes to generate a swirled fuel flow and a second opening at the aft end of the chamber, wherein the second plurality of vanes are spaced apart from the aft end;

a third annular passage disposed about the second annular passage, the third annular passage including a third plurality of vanes to generate a swirled second airflow and a third opening at the aft end of the chamber, wherein the third plurality of vanes are spaced apart from the aft end;

a plurality of openings through the bulkhead of the chamber for communicating a central airflow to the chamber; and a plurality of fuel tubes disposed about the axis and extending through the bulkhead into the chamber to communicate a second fuel flow to the chamber, wherein each of the plurality of fuel tubes includes an aft end that opens into the chamber and each of the ends are spaced axially away from the aft end of the chamber such that each of the plurality of fuel tubes communicate with the chamber.

6. The fuel injector as recited in claim 5, wherein the plurality of fuel tubes includes a central tube disposed along the axis and a first plurality of fuel tubes disposed about the central tube, with at least some of the plurality of openings disposed between the central tube and the first plurality of fuel tubes.

7. The fuel injector as recited in claim 6, including a second plurality of fuel tubes disposed about the first plurality of fuel tubes with at least some of the plurality of openings disposed between the first plurality of fuel tubes and the second plurality of fuel tubes.

8. The fuel injector as recited in claim 5, including a fuel manifold disposed at a forward end of the plurality of fuel tubes for supplying fuel.

9. The fuel injector as recited in claim 8, including an annular fuel chamber disposed forward of the second annular passage, the annular fuel chamber including a plurality of fuel inlets for receiving a fuel flow.

10. The fuel injector as recited in claim 5, including a duct extending from the aft end of the chamber to a combustion chamber.

11. The fuel injector as recited in claim 5, wherein the second annular passage is disposed between the first annular passage and the third annular passage.

12. The fuel injector as recited in claim 5, wherein the aft end of each of the plurality of fuel tubes extends into the chamber and is spaced apart from the opening at the aft end of the chamber.

13. The fuel injector as recited in claim 5, wherein at least one of the first plurality of vanes, the second plurality of vanes and the third plurality of vanes are disposed axially between the bulkhead and the aft end of the chamber.

* * * * *